US009993780B2

(12) United States Patent
Foutel et al.

(10) Patent No.: US 9,993,780 B2
(45) Date of Patent: Jun. 12, 2018

(54) MACHINE FOR DUSTING A PROFILED ROOF TILE COMPRISING RAISED PATTERNS WITH PARTICULATE MATTER

(71) Applicant: ONDULINE, Levallois Perret (FR)

(72) Inventors: Martin Foutel, Menneval (FR); Fabien Barre, Gonnetot (FR)

(73) Assignee: ONDULINE, Levallois-Perret (FR)

( * ) Notice: Subject to any disclaimer, the term of this patent is extended or adjusted under 35 U.S.C. 154(b) by 3 days.

(21) Appl. No.: 15/032,467

(22) PCT Filed: Nov. 6, 2014

(86) PCT No.: PCT/FR2014/052845

§ 371 (c)(1),
(2) Date: Apr. 27, 2016

(87) PCT Pub. No.: WO2015/067905

PCT Pub. Date: May 14, 2015

(65) Prior Publication Data

US 2016/0250659 A1 Sep. 1, 2016

(30) Foreign Application Priority Data

Nov. 7, 2013 (FR) ..... 13 60918

(51) Int. Cl.
*B01F 5/24* (2006.01)
*B05C 19/04* (2006.01)
(Continued)

(52) U.S. Cl.
CPC ..... *B01F 5/246* (2013.01); *B05C 19/04* (2013.01); *E04D 3/24* (2013.01); *E04D 3/34* (2013.01);
(Continued)

(58) Field of Classification Search
CPC . B05C 19/00; B05C 19/04; Y10T 428/31815; B01F 5/246; B01F 5/205
See application file for complete search history.

(56) References Cited

U.S. PATENT DOCUMENTS 2,111,565 A * 3/1938 Limerick ..... B05C 19/00 427/187
3,184,324 A 5/1965 Edward
(Continued)

FOREIGN PATENT DOCUMENTS

GB 1 257 301 A 12/1971

OTHER PUBLICATIONS

International Search Report, dated Mar. 2, 2015, from corresponding PCT application.

*Primary Examiner* — Karl Kurple
(74) *Attorney, Agent, or Firm* — Young & Thompson

(57) ABSTRACT

A machine for dusting a shape with particulate matter, the shape being a profiled roof tile including raised patterns extending in the lengthwise direction thereof, and including raised portions laterally separated from hollow portions by sloped portions, the tile having a predetermined width, and being preferably corrugated, the machine including a dusting element forming a homogeneous linear curtain of particulate matter falling across the width of the tile, the tile travelling longitudinally under the linear curtain. Deflectors of the curtain are arranged above the tile to intercept the particulate matter above the areas at the bottom of the sloped portions and redistribute the intercepted particulate matter towards an intermediate level of each corresponding sloped portion in order for the amount of particulate matter on the surface of the plate ultimately to be substantially homogeneous after a portion of intercepted particulate matter has slid towards the bottom of the sloped portion.

10 Claims, 3 Drawing Sheets

(51) Int. Cl.

| | |
|---|---|
| ***E04D 3/34*** | (2006.01) |
| ***E04D 3/24*** | (2006.01) |
| *E04D 1/00* | (2006.01) |
| *B05C 19/06* | (2006.01) |

(52) U.S. Cl.
CPC ..... *B05C 19/06* (2013.01); *E04D 2001/005* (2013.01)

(56) References Cited

U.S. PATENT DOCUMENTS 4,610,902 A * 9/1986 Eastman ..... B32B 11/04 427/186
4,617,198 A * 10/1986 Overturf ..... B05C 19/00 427/186
4,798,164 A * 1/1989 Marazzi ..... B05C 19/04 118/308
5,382,291 A * 1/1995 Olioso ..... D06N 5/00 118/212
5,531,831 A * 7/1996 Sweeney ..... B05C 19/04 118/308
5,670,237 A * 9/1997 Shultz ..... B29C 43/222 427/198
5,795,389 A * 8/1998 Koschitzky ..... B05C 19/06 118/308
8,261,687 B2 * 9/2012 Kim ..... B01J 37/0215 118/309
8,435,599 B1 * 5/2013 Standeford ..... D06N 5/003 427/186
8,453,594 B2 * 6/2013 Oldorff ..... B05C 1/0813 118/223
9,415,417 B2 * 8/2016 Kwon ..... B05C 11/1021
9,731,304 B2 * 8/2017 Paris ..... B01J 2/006
2002/0114871 A1 8/2002 Graham et al.
2016/0167067 A1 * 6/2016 Paris ..... B01J 2/006 427/212

* cited by examiner

MACHINE FOR DUSTING A PROFILED ROOF TILE COMPRISING RAISED PATTERNS WITH PARTICULATE MATTER

BACKGROUND OF THE INVENTION

Field of the Invention

The present invention relates to a machine for dusting a particulate matter on a profiled roofing sheet having raised patterns. It allows a homogeneous distribution, i.e. of constant thickness, of the particulate matter, herein solid particles, across the surface of the sheet despite the presence of raised elements thereon. It has industrial applications in the field of the manufacturing of cover elements, in particular corrugated sheets made of cellulosic fibres impregnated with bitumen.

Description of the Related Art

To provide the corrugated roofing sheets with particular properties, it is sometimes necessary to deposit on the surface of these latter, in quantities identical in any point, solid particles such as flakes or granules, such matters being herein generically called "particulate matters".

For evident reasons linked to the geometry, the film of solid particles obtained after conventional gravity coating through a dry process is not of constant thickness and depends directly on the geometric profile of the sheet. This gravity coating is conventionally performed with a hopper discharging the particulate matter as a linear curtain on the surface of the sheet.

Figure 1:
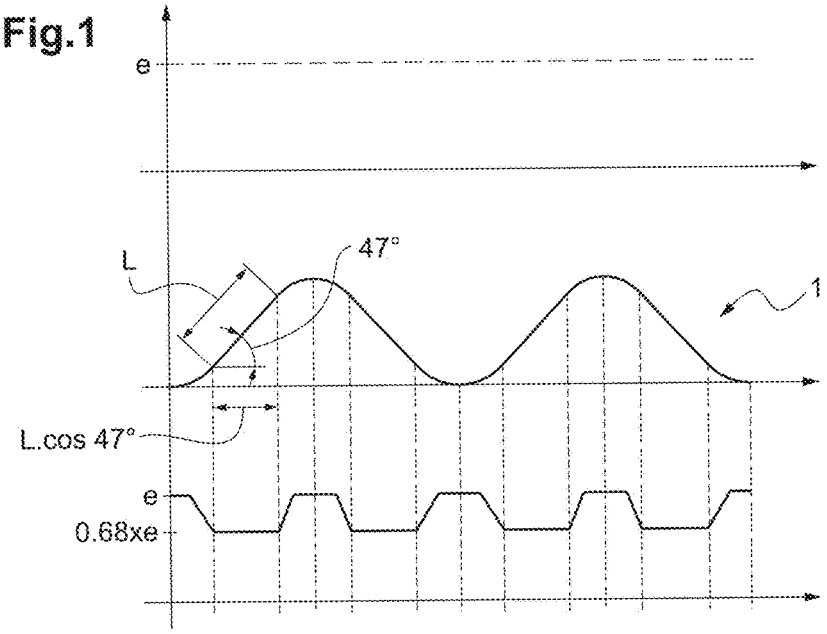

FIG. 1 shows the theoretical profile of covering linked to what is called herein the "Geometry" effect. When a film, of supposed thickness e, has just been deposited in corrugation crest or in corrugation trough of a corrugated sheet 1, by geometric projection, the thickness of the film induced on the sides/sloping parts of the corrugations will be of the order of 0.68*e, with the indicated values of angle (47°) and length L of slope.

In addition to the "Geometry" effect, another effect is added up, which is called herein the "Gravity" effect, linked to the sliding of the solid particles on the inclined plans, in particular the sides/sloping parts of the corrugations, where the coefficient of friction is lower than the force of gravity.

Figure 2:
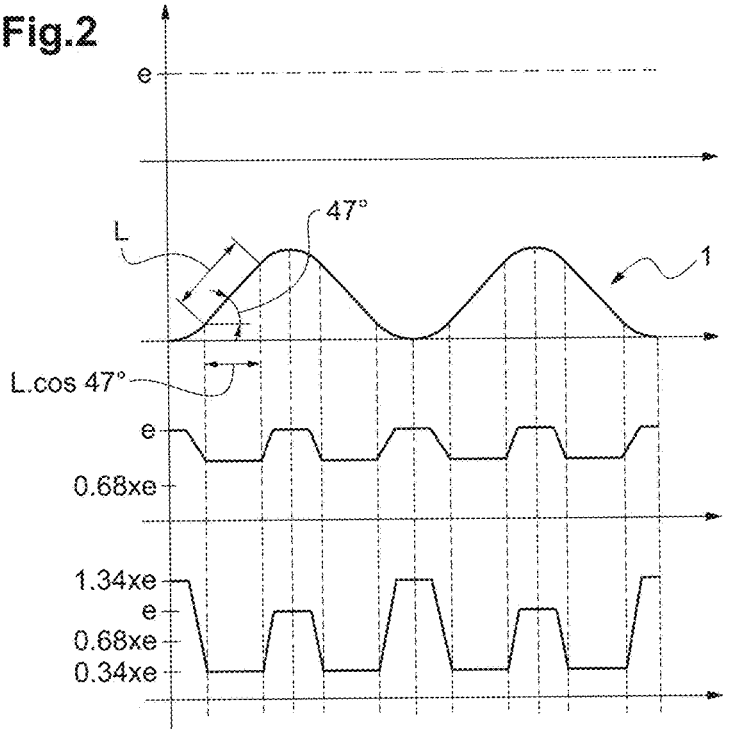
Figure 3:
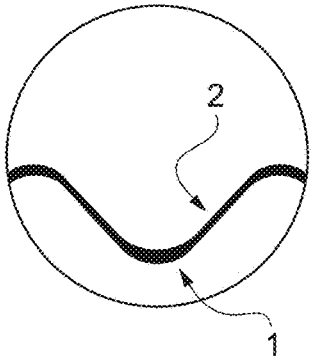

FIG. 2 shows a new theoretical profile of distribution of the solid particles degraded by the "Gravity" effect. A part of the solid particles applied on the corrugation sides of the corrugated sheet 1 slides towards the valleys, hence an accumulation and an increase of the quantity at this place and, consequently, an impoverishment of the quantity at the place of the sliding. Only, in corrugation crest, the deposited quantity corresponds to the target value. In other words, when a film of solid particles of thickness e has just been deposited in corrugation crest, by geometrical projection then sliding linked to the gravity, the thickness of the film induced on the corrugation sides will be of the order 0.34*e and in the valleys of the order of 1.34*e. This effect is represented in FIG. 3, which shows a magnification of a part of a corrugated roofing sheet and in which it can be seen that the sides/sloping parts have finally less particulate matter and that the latter tends to accumulate in the troughs, at the bottom of said sloping parts.

It is hence desirable to find a solution in order to make the distribution of the solid particles on the surface of the corrugated profile the most homogeneous possible, and that for any element of surface. Several means can be contemplated to achieve this objective. For example, the implementation of air blowing systems for displacing the excess of matter in the profile valleys towards the corrugation sloping parts/sides or the use of a profiled doctor blade in order to modify the concentration of the curtain of solid particles at the beginning of the application and corresponding to the needs.

However, in the particular case of a corrugated cover sheet, these two techniques, known from the one skilled in the art, generate cumbersome dysfunctions as for example a sliding of the particles, an air blowing difficult to adjust between an excess and a deficiency, a doctor blade that is badly adapted to lamellar particles.

It is hence proposed another solution, which is based on the use of deflectors disturbing the flow of solid particles falling in free fall on the sheet, also called a curtain of particles/particular matter, so as to better distribute these particles across the sheet surface taking into account the two above-mentioned effects, i.e. the "Geometry" effect and the "Gravity" effect.

Moreover, the document US-2002/0114871A1 is known, which relates to the dusting of food crisps by spices. Vibrating fingers forming vibrating chimneys distribute the spices on the crisps. However, the impact of the corrugations of the crisps on the final distribution across the surface of the crisps is not taken into account.

The document U.S. Pat. No. 3,184,324 discloses a device for spreading granules across a flat cover element. The granules fall in bands in particular areas and are guided in their fall by guides. The cover element is flat and the guides cause naturally an accumulation of granules at the limit of the bands of granules formed on the surface of the element.

SUMMARY OF THE INVENTION

The invention thus relates to a machine for dusting a shape with a particulate matter, said shape being a profiled roofing sheet having raised patterns extended in the direction of the length thereof, said raised patterns having elevated parts laterally separated from trough parts by inclined sloping parts, said sheet having a determined width, the machine including a dusting means forming a linear curtain of particulate matter falling transversally, across the width of the sheet, and driving means for a relative translational displacement of the sheet with respect to the curtain of particulate matter.

According to the invention, deflectors of the curtain of particulate matter are arranged above the bottom areas of the inclined sloping parts of the sheet so as to transversally divert the direction of the vertical flow of parts of the curtain of particulate matter above said bottom areas of the inclined sloping parts to redistribute the diverted particular matter towards an intermediate level of each corresponding inclined sloping part so that the quantity of particulate matter at the surface of said sheet is finally substantially homogeneous after sliding towards the bottom of said inclined sloping part of a part of the particulate matter that had been diverted.

Hence, the homogeneous final distribution of the particulate matter on the corrugated surface of the cover sheet is obtained by the principle that consists in intercepting the particulate matter that falls in a curtain towards the sheet, in the parts of the curtain opposite/above the bottom parts of sloping parts to laterally/transversally redistribute it at an intermediate height of the corresponding sloping part, a part of the redistributed particulate matter ending up sliding along the sloping part to equalize the distribution at the surface of the sheet.

In various embodiments of the invention, the following means, which can be used alone or in any technically possible combination, are used:

the sheet is in particular a corrugated cover sheet, the sheet moves longitudinally under the linear curtain of particulate matter, each elevated part forms an upwardly convex pattern and the two lateral sloping parts, on each side of the elevated part, are downwardly divergent, the sheet may end laterally by a terminal elevated part, said terminal elevated part having then only one lateral sloping part, the interception of the particulate matter by the deflector is total, the area opposite/under the deflector not receiving directly particulate matter of the curtain of particulate matter, the interception of the particulate matter by the deflector is partial, the area opposite/under the deflector receiving directly only a part of the particulate matter of the curtain of particulate matter, said deflector being formed of a grid or screen letting pass through a part of the particulate matter of the curtain of particulate matter and redistributing the remaining towards an intermediate level of the inclined sloping part, the interception of the particulate matter by the deflector is mixed, a part of the deflector intercepting the totality of the particulate matter and another part only partially to redistribute it, each deflector includes at least one upper face of interception and deflection of the particulate matter of the curtain, each upper face having an inclination of uniform direction, opposite to the direction of inclination of the sloping part above which it is located, the inclination is of uniform direction because it does not change of sign for an upper face above a given bottom of inclined sloping part, an upper face of deflector ends on one side, substantially opposite/above the bottom point of the sloping part or opposite/above the trough part and, on the other side, opposite/above an intermediate point of the corresponding sloping part, the flow of the curtain of particulate material is not modified above the elevated parts of the sheet, the sheet is a corrugated cover sheet with regular corrugations and each deflector includes two upper faces and of upwardly convex transverse shape, each deflector being arranged opposite/above the trough parts of the corrugations, each of said upwardly convex shapes having an apex/crest line and being symmetrical with respect to its apex/crest line elongated in the direction of the sheet length, perpendicularly to the curtain of particulate material, each convex-shaped deflector includes two upper faces of interception of the particulate matter, lateral to the apex/crest line, chosen among:

the planar faces, or the downwardly curved faces, each of the two upper faces of the deflector being then partially upwardly concave, or the upwardly curved faces, each of the two upper faces of the deflector being then partially upwardly convex, the deflector has a reverse V-shaped transverse shape, the reverse V-shaped deflector with planar upper faces is hollow, the reverse V-shaped deflector with planar upper faces is solid, the deflector with upwardly curved upper faces has an arc-of-a-circle or sinusoid-part transverse shape, the deflector is symmetrical, the sheet is a corrugated cover sheet with alternated corrugations, two adjacent corrugations forming two elevated parts being separated by a planar area forming a trough part and each deflector includes an upper face having an inclination of uniform direction, opposite to the direction of inclination of the sloping part above which it is located, the upper face of each deflector is chosen among:

a planar face, or a downwardly curved face, said upper face of the deflector being then partially upwardly concave, or an upwardly curved face, said upper face of the deflector being then partially upwardly convex, the dusting means intended to produce the homogeneous linear curtain of particular matter includes a means for air spraying the particulate matter, the deflectors are adjustable in height with respect to the sheet, the inclination of the upper faces of the deflectors is adjustable, the dusting means is a hopper for the distribution of the particulate matter arranged above the sheet, said distribution hopper spreading uniformly said particulate matter across the width thereof and including a linear downward end oriented according to the width of the sheet and from which downward end said particulate matter falls freely towards said sheet hence forming an homogeneous linear curtain of particulate matter, the curtain of particulate matter is homogeneous because the quantity of matter along the curtain is identical in any point at the exit of the hopper, the distribution hopper is vibrating, the sheet is vibrated, the deflectors are vibrating, as an alternative, the profiled cover sheet is fixed during the dusting, the dusting means forming the linear and homogeneous curtain of particulate matter falling on the sheet being mobile over the length of the sheet, the machine includes regular driving means of the profiled cover sheet and the dusting means forming the linear and homogeneous curtain of particular matter falling on the sheet is fixed, the machine includes regular driving means of the profiled cover sheet and the dusting means forming the linear and homogeneous curtain of particular matter falling on the sheet is mobile but in a direction opposite to the driving of the sheet, the sheet has sinusoidal corrugations, the sheet is a corrugated cover sheet further including at least one vertical sloping part between an elevated part and a trough part and no deflector is present above a vertical sloping part.

The invention also relates to the method that makes it possible to obtain a homogeneous distribution of particular matter across the surface of a roofing sheet having raised patterns by means of deflectors and according to all the implementation modes. In particular, the direction of the vertical flow of the parts of the curtain of particulate matter above the bottom areas of the inclined sloping parts is transversely diverted, by means of deflectors, to redistribute the diverted particulate matter towards an intermediate level of each corresponding inclined sloping part so that the quantity of particulate matter at the surface of said sheet is finally substantially homogeneous after sliding towards the bottom of said inclined sloping part of a part of the particular matter that had been diverted.

BRIEF DESCRIPTION OF THE DRAWING FIGURES

Figure 4:
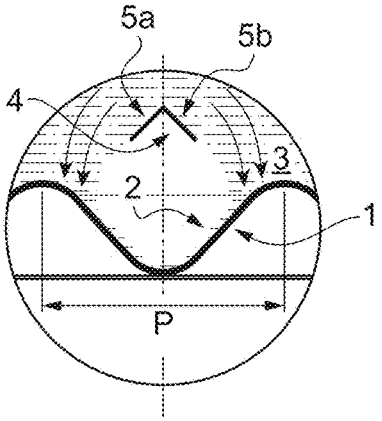
Figure 5:
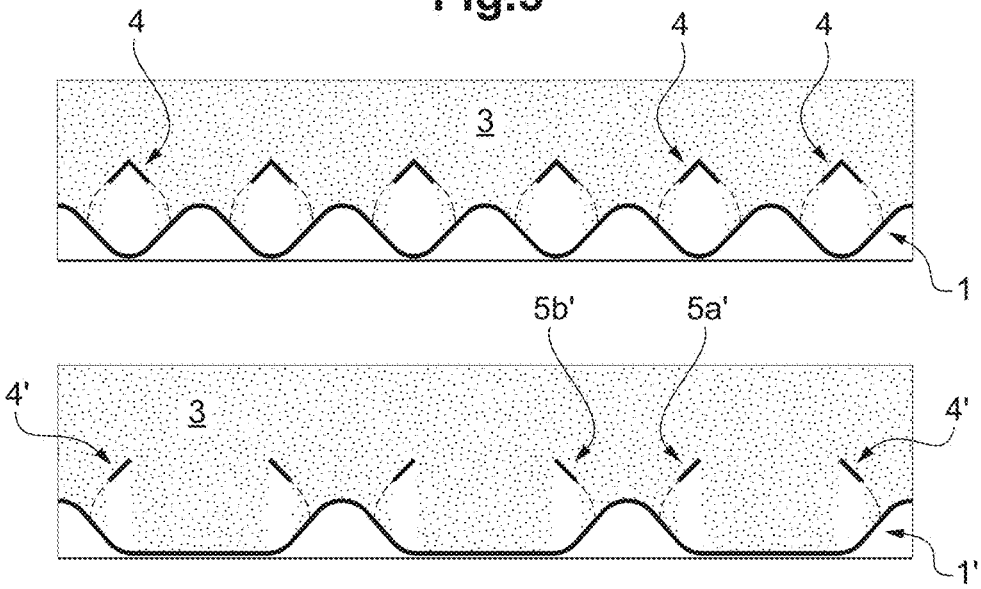
Figure 6:
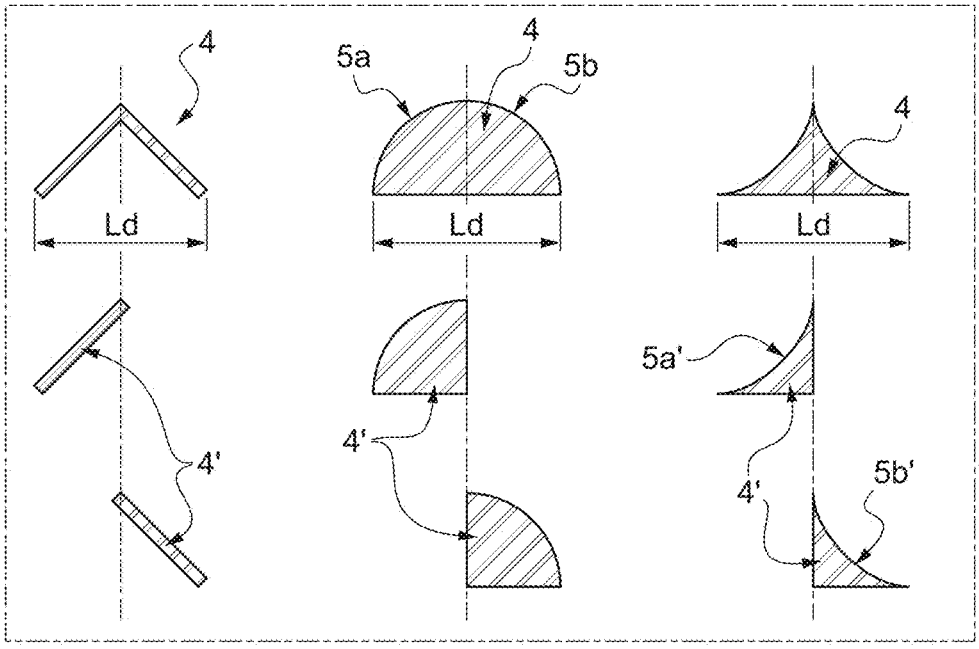
Figure 7:
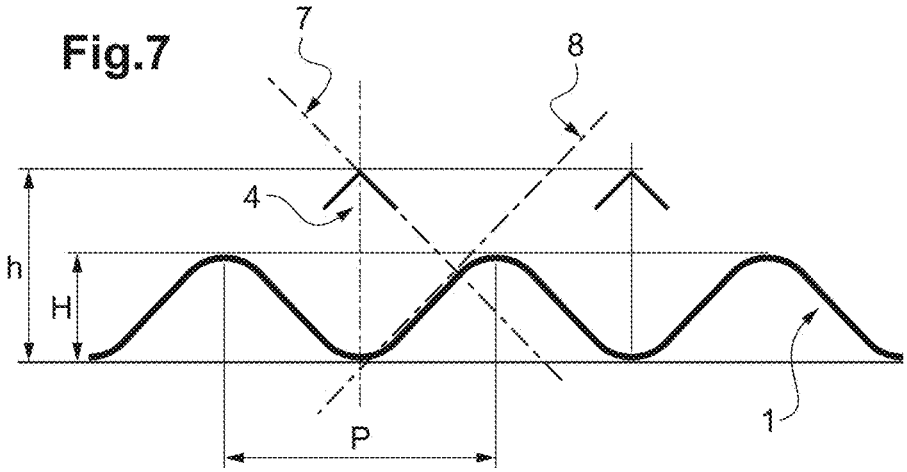
Figure 8:
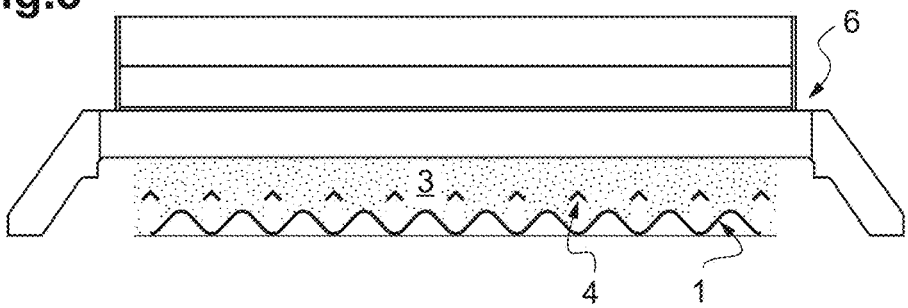

The present invention will now be exemplified, without being limited thereby, by the following description of embodiments and implementations in relation with:

FIG. 1, which shows three juxtaposed graphs with, from the top to the bottom, the thickness e of matter supposed to be deposited at the surface of the sheet, the corrugated profile of the sheet, the thickness obtained at the surface of the sheet (by simplified calculation taking into account only the sheet profile), FIG. 2, which shows four juxtaposed graphs with, from the top to the bottom, the thickness e of matter supposed to be deposited at the surface of the sheet, the corrugated profile of the sheet, the thickness obtained at the surface of the sheet (by simplified calculation taking into account only the sheet profile), the thickness obtained at the surface of the sheet (by simplified calculation taking into account both the sheet profile and the gravity making so that the particulate matter slides/rolls along the sloping part), FIG. 3, which shows a magnification of a part of the sheet, viewed in profile, in the axis of the length thereof, and showing the effect of inhomogeneity on the distribution of the particulate matter both of the sheet profile and of the gravity making so that the particulate matter slides/rolls along the sloping part, FIG. 4, which shows the principle of the deflection of the particulate matter to obtain an homogeneous distribution of the particulate matter at the surface of the sheet, FIG. 5, which shows two applications of the invention to two types of cover sheets, the first with a sheet having regular corrugations and the second with corrugations alternating with flats, FIG. 6, which shows several examples of deflectors with, on the top line, deflectors adapted for a sheet having regular corrugations and, on the two bottom lines, deflectors adapted for a sheet having corrugations alternating with flats, FIG. 7, which shows dimensional variables having an influence on the result of the invention, and FIG. 8, which shows a schematic view of the machine of the invention.

The invention hence permits to make uniform the distribution of particulate matter, for example a fire-protection particulate coating, on the surface of a corrugated cover sheet 1, 1', in particular a sheet of cellulose impregnated with bitumen, during an operation of dusting of the sheet with a linear particulate curtain 3 making it possible to linearly deposit the particulate matter on the sheet. During this operation, the sheet moves perpendicularly to the particulate curtain 3, this latter being preferably extended across the width of the sheet and the sheet moving according to its length under the curtain of particulate matter.

The sheet has raised patterns extended in the direction of the length thereof, said raised patterns having elevated parts separated laterally from trough parts by sloping parts inclined from the top to the bottom and laterally. Each elevated part hence forms a convex shape towards the top and the two lateral inclined sloping parts on each side of the elevated part are downwardly divergent.

To make the distribution of the particulate matter 2 on the sheet 1, 1' uniform, a deflector 4, 4' is installed above and opposite (in other word right above) the lower area or bottom part of each sheet sloping part. An example of implementation is illustrated by FIG. 4 for a regular-corrugation sheet 1 for which each deflector includes two upper faces of interception/deflection 5*a*-5*b* of inclinations opposite to those of the bottom of the respective sloping part opposite/above which they are arranged. By way of example, in FIG. 6 is shown the inclination 7 of the upper face 5*b* of the deflector 4 and the inclination 8 of the sloping part above which it is located, these inclinations 7 and 8 are opposite to each other.

DETAILED DESCRIPTION OF THE INVENTION

We specify herein the double function "interception/deflection" because it is understood that the deflection occurs only because there is also interception of the flow of particulate matter of the curtain 3.

It will be seen that, for a sheet with corrugations alternated with a flats 1', each deflector includes only an upper face of interception/deflection 5*a*' or 5*b*'.

The equalization of the distribution of the particulate matter 2 on the sheet 1 can be optimized by acting on several parameters. Among these parameters, it can be mentioned:

- the number of deflectors 4, 4', to be chosen as a function of the profile of the corrugated sheet,
- the geometrical shape and the size of the deflector, in particular its upper face of interception/deflection 5*a*-5*b*, 5*a*' or 5*b*',
- the positioning in space of each deflector according to the profile of the corrugated sheet,
- the matter or the state of surface of the deflectors 4, 4'.

The number of deflectors is linked to the geometrical profile of the corrugated sheet and, more specially, to the number of corrugations, and hence of sloping parts, given that there must be an upper face of interception/deflection opposite/above each bottom area of the sloping part if it is wanted to finally obtain a uniform distribution over the whole width of the sheet surface. This parameter is hence relatively constrained.

Hence, in FIG. 5, we have, at the top, for the regular-corrugation sheet 1, a deflector 4 with two upper faces of deflection 5*a*-5*b* each opposite/above each trough part of the plate. Still in FIG. 5, we have, at the bottom, for the alternated-corrugation sheet 1' (elevated parts between flats), a deflector 4' with one upper face of interception/deflection 5*a*' or 5' each opposite/above each bottom area of the sloping part.

It is understood that the shape of the upper face(s) of interception/deflection 5*a*-5*b*, 5*a*' or 5*b*' may be optimized as a function of the needs, in particular taking into account an effect of this shape to send more or less laterally far from the deflector the particulate matter that has been intercepted.

By way of example, several general types of deflector shapes have been shown in FIG. 6. On the top line, the deflectors 4 are adapted to a sheet 1 with regular corrugations, and, from the left to the right, we have upper faces of interception/deflection 5*a*-5*b*: planar; upwardly curved faces, that is to say that each upper face of interception/deflection is partially upwardly convex; and downwardly curved faces, that is to say that each upper face of interception/deflection is partially upwardly concave.

On the two bottom lines of FIG. 6, the deflectors 4' are adapted to a sheet 1' with corrugations alternating with flats, and, from the left to the right, we have an upper face of interception/deflection 5*a*' or 5*b*': planar; an upwardly curved face, that is to say an upper face of interception/deflection partially upwardly convex; and a downwardly curved faces, that is to say an upper face of interception/deflection partially upwardly concave.

In FIG. 6, the dimension Ld (projected width of the deflector) can be adjusted as a function of the shape of the corrugation, in particular the corrugation Height H and the corrugation Pitch P, such dimensional variables being represented in FIG. 7.

In the case of a regular-corrugation sheet, in the horizontal axis, the axis of symmetry of the deflector must be merged with the axis of symmetry of the repeated geometrical pattern of the sheet profile considered as located in the bottom part of the patterns. In the vertical axis, the positioning of the deflector in height h is adjusted experimentally, with the corrugation height H of the sheet profile.

The length of each deflector must be sufficient to intercept efficiently and to redistribute the particulate matter of the curtain of particulate matter.

The state of surface of the deflector must be chosen as a function of the particulate to be deposited so as to avoid the problems of electrostatic charges, the problems linked to the frictions (coefficient of friction), the problems of wearing. This list is not exhaustive.

In the case of a coating of flakes of graphite, a deflector made of aluminum seems particularly adapted.

Taking into account the four variables of adjustment described hereinabove, it has been shown, in a machine implementing deflectors according to the invention, that the homogeneity of the distribution of the solid particles applied by gravity on the surface of a corrugated sheet was greatly improved. In the machine in question, it has been implemented brushed-aluminum deflectors of geometrical shape of the angle type of 25 mm, positioned in the axis of symmetry of the corrugations at a height h=1.5*H.

It is to be noted that, except advanced optimization, for example with partial interception of the particulate matter, it is in practice impossible to totally compensate for the "Geometry" effect. However, in the common practice of a total-interception deflector, the profile corrected using a chosen deflector, adapted and regulated, makes it possible to get strongly closer to the ideal profile (iso-thickness).

Thanks to the invention, the coating of flake of graphite at the surface of the corrugated sheets to improve the fire resistance has permitted to pass with success all the tests of resistance to an external fire contrary to the corrugated sheets for which the coating had been made without implementation of the deflectors of the invention.

In FIG. 8, the machine of the invention is schematized in longitudinal view and a corrugated sheet 1 moves in translation under a fixed hopper 6 that produces a curtain of particular matter 3. Deflectors 4 intercept and redistribute the particular matter of the curtain of particulate matter opposite/above trough parts of the corrugated sheet to send back the particulate matter intercepted higher along sloping parts of the corrugated sheet 1.

The invention claimed is:

1. A system for dusting a shape with a particulate matter, said shape being a profiled roofing sheet having raised patterns extended in the direction of the length thereof, said raised patterns having elevated parts laterally separated from trough parts by sloping parts which are inclined, said profiled roofing sheet having a determined width, said system including a machine;

the machine comprising:

a hopper adapted for distribution of the particulate matter and creating an homogeneous curtain of the particulate matter falling transversally, across the width of the profiled roofing sheet, said curtain of the particulate matter is linear; the profiled roofing sheet having a relative translational displacement with respect to the curtain of the particulate matter;

deflectors of the curtain of particulate matter are arranged under the hopper and directly above bottom areas of the sloping parts of the profiled roofing sheet, so as to transversally divert a direction of a vertical flow of parts of the curtain of the particulate matter directly above the bottom areas of the sloping parts to redistribute diverted portions of particulate matter towards an intermediate level of each corresponding sloping part so as to homogenize the quantity of the particulate matter at a surface of said profiled roofing sheet after sliding, towards the bottom of the sloping part, of the diverted portions of the particulate matter; and each deflector includes at least one upper surface face of interception and deflection of the particulate matter of the curtain, each upper face having an inclination of uniform direction, opposite to the direction of inclination of a sloping part above which the deflector is located.

2. The system according to claim 1, wherein the flow of the curtain of the particulate matter is not modified above the elevated parts of the profiled roofing sheet.

3. The system according to claim 1, wherein the shape is a corrugated cover sheet with regular corrugations and each deflector includes two upper faces and is of upwardly convex transverse shape, each deflector being arranged above the trough parts of the corrugations, each of said upwardly convex shapes having a crest line and being symmetrical with respect to the crest line that is elongated in a direction of a corrugated cover sheet length, perpendicularly to the curtain of particulate matter.

4. The system according to claim 3, wherein each deflector of convex shape includes two upper faces of interception of the particulate matter, lateral to the crest line, said upper faces are among:

planar faces, or downwardly curved faces, each of the two upper faces of the deflector being then partially upwardly concave, or upwardly curved faces, each of the two upper faces of the deflector being then partially upwardly convex.

5. The system according to claim 1, wherein the shape is a corrugated cover sheet with alternated corrugations, two adjacent corrugations forming two elevated parts being separated by a planar area forming the trough part and each deflector includes an upper face having an inclination of uniform direction, opposite to the direction of inclination of the sloping part above which the deflector is located.

6. The system according to claim 5, wherein the upper face of each deflector is chosen among:

a planar face, or a downwardly curved face, said upper face of the deflector being then partially upwardly concave, or an upwardly curved face, said upper face of the deflector being then partially upwardly convex.

7. The system according to claim 1, wherein the deflectors are adjustable in height with respect to the profiled roofing sheet.

8. The system according to claim 1, wherein the hopper for the distribution of the particulate matter is arranged above the profiled roofing sheet, the distribution hopper spreading uniformly said particulate matter across the width thereof and including a linear downward end oriented according to the width of the profiled roofing sheet and from which downward end said particulate matter falls freely towards the profiled roofing sheet hence creating the homogeneous curtain of the particulate matter.

9. The system according to claim 1, wherein the hopper creating the homogeneous curtain of the particular matter falling on the profiled roofing sheet is fixed, and the profiled roofing sheet is displaced evenly.

10. The system according to claim 1, wherein the profiled roofing sheet and the hopper creating the homogeneous curtain of the particular matter falling on the profiled roofing sheet are evenly mobile but in opposite directions.

* * * * *